US010139773B2

(12) United States Patent
Ogasahara

(10) Patent No.: US 10,139,773 B2
(45) Date of Patent: Nov. 27, 2018

(54) FIXING TOOL AND IMAGE FORMING APPARATUS

(71) Applicant: KYOCERA Document Solutions Inc., Osaka-shi, Osaka (JP)

(72) Inventor: Okito Ogasahara, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/473,456

(22) Filed: Mar. 29, 2017

(65) Prior Publication Data

US 2017/0285564 A1 Oct. 5, 2017

(30) Foreign Application Priority Data

Mar. 30, 2016 (JP) ..... 2016-068715

(51) Int. Cl.
*G03G 21/16* (2006.01)
*G03G 15/00* (2006.01)

(52) U.S. Cl.
CPC ..... *G03G 21/1647* (2013.01); *G03G 15/6502* (2013.01)

(58) Field of Classification Search
CPC ..... G03G 21/1647
USPC ..... 399/393
See application file for complete search history.

(56) References Cited

U.S. PATENT DOCUMENTS 4,141,138 A * 2/1979 Quick ..... H05K 13/0417 29/740
D340,173 S * 10/1993 Feng ..... H05K 13/0486 D28/55
5,697,022 A * 12/1997 Matsuda ..... G03G 21/1832 399/102
6,634,891 B1 * 10/2003 Cheng ..... H05K 13/0486 29/741
7,314,382 B2 * 1/2008 Nolan ..... H01R 43/26 439/353

(Continued)

FOREIGN PATENT DOCUMENTS

JP 61033447 U 2/1986
JP 04042166 A 2/1992

(Continued)

OTHER PUBLICATIONS

Japanese Patent Office, Office Action Issued in Application No. 2016068715, dated Aug. 20, 2018, 7 pages.

*Primary Examiner* — Anthony Nguyen
(74) *Attorney, Agent, or Firm* — Alleman Hall Creasman & Tuttle LLP

(57) ABSTRACT

A fixing tool includes a pair of arms, a holding portion, and a claw portion. The arms are capable of being inserted into and pulled out from through holes formed respectively in a sheet support plate, which supports a sheet stored in a sheet feeder of an image forming apparatus such that the sheet can be lifted and lowered, and in a bottom portion of the sheet feeder. The holding portion is provided so as to project from a predetermined position on each of the arms and capable of holding the sheet support plate and the bottom portion. The claw portion is provided so as to project inward from a distal end of each of the arms and capable of being inserted between an integrated circuit mounted in the image forming apparatus and a mounting target portion which the integrated circuit is mountable to and detachable from.

5 Claims, 12 Drawing Sheets

(56) References Cited

U.S. PATENT DOCUMENTS

| | | | | |
|---|---|---|---|---|
| 7,384,086 | B2 * | 6/2008 | Lukaszynski | H01H 85/0208 29/278 |
| 8,770,578 | B2 * | 7/2014 | Yamamoto | B65H 1/266 271/171 |
| 9,604,348 | B2 * | 3/2017 | Wu | B25B 9/02 |
| 2005/0078969 | A1 | 4/2005 | Kikuchi | |
| 2008/0022053 | A1 | 1/2008 | Kikuchi | |

FOREIGN PATENT DOCUMENTS

| | | | |
|---|---|---|---|
| JP | 2005070254 | A | 3/2005 |
| JP | 2007197204 | A | 8/2007 |

* cited by examiner

FIXING TOOL AND IMAGE FORMING APPARATUS

INCORPORATION BY REFERENCE

This application is based upon and claims the benefit of priority from the corresponding Japanese Patent Application No. 2016-068715 filed on Mar. 30, 2016, the entire contents of which are incorporated herein by reference.

BACKGROUND

The present disclosure relates to a fixing tool for fixing a sheet support plate, which supports sheets stored in a sheet feeder of an image forming apparatus such that the sheets can be lifted and lowered, to a bottom portion of the sheet feeder; and an image forming apparatus including the fixing tool.

An image forming apparatus such as a copying machine or a multifunction peripheral includes a fixing tool for fixing a sheet support plate, which supports sheets stored in a sheet feeder such that the sheets can be lifted and lowered, to a bottom portion of the sheet feeder. Such a fixing tool becomes unnecessary when the need to fix the sheet support plate is eliminated.

Meanwhile, an image reading device or an image forming apparatus such as a multifunction peripheral includes an integrated circuit (IC) which controls an image forming portion or an image reading portion. Such an integrated circuit is mountable to and detachable from an IC socket which is provided on a control board of the image forming apparatus or the like. As a pulling-out tool for pulling out such an integrated circuit from the IC socket, a tool having a pair of levers each having a wedge portion formed at a lower end thereof has been known.

SUMMARY

A fixing tool according to an aspect of the present disclosure includes a pair of arms, a holding portion, and a claw portion. The pair of arms are capable of being inserted into and pulled out from through holes formed respectively in a sheet support plate, which supports a sheet stored in a sheet feeder of an image forming apparatus such that the sheet can be lifted and lowered, and in a bottom portion of the sheet feeder. The holding portion is provided so as to project from a predetermined position on each of the arms and capable of holding the sheet support plate and the bottom portion. The claw portion is provided so as to project inward from a distal end of each of the arms and capable of being inserted between an integrated circuit mounted in the image forming apparatus and a mounting target portion which the integrated circuit is mountable to and detachable from.

An image forming apparatus according to another aspect of the present disclosure is an image forming apparatus including: the sheet feeder; an image forming portion configured to form an image on a sheet supplied from the sheet feeder; and the integrated circuit, wherein the sheet feeder includes the fixing tool and a storage portion in which the fixing tool can be stored.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

First Embodiment

Figure 1:
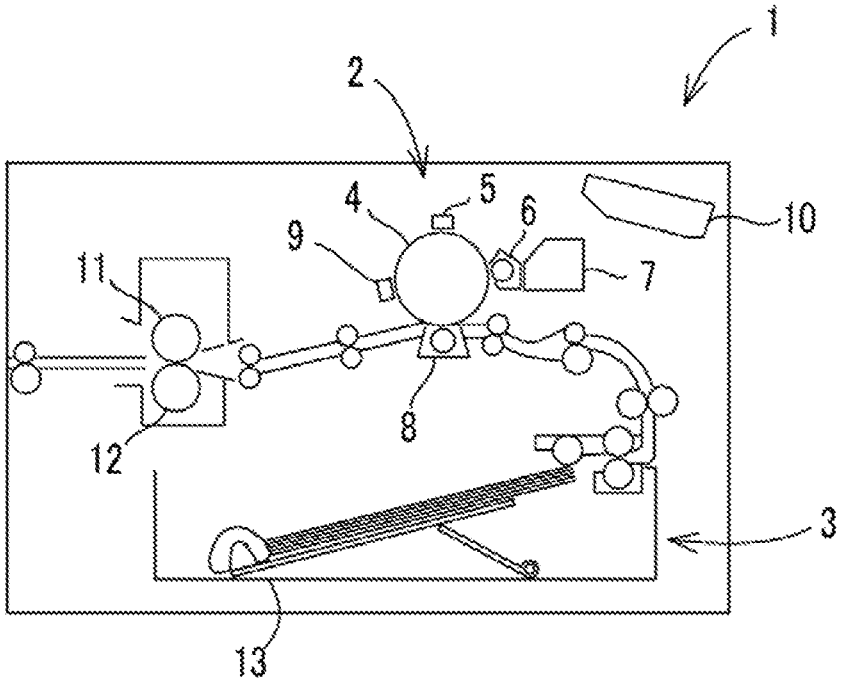
FIG. 1 is a diagram showing the configuration of an image forming apparatus according to a first embodiment of the present disclosure.

A first embodiment of the present disclosure will be described with reference to FIG. 1. An image forming apparatus 1 according to the present embodiment is a printer. However, the image forming apparatus of the present disclosure is not limited to a printer, and may be, for example, a facsimile apparatus, a copying machine, a multifunction peripheral having an image reading function, a facsimile function, and an image forming function, or the like.

The image forming apparatus 1 performs an image forming process on a sheet P1 on the basis of image data inputted from an external device such as a personal computer or a USB memory. The image forming apparatus 1 includes an image forming portion 2 and a sheet feed portion 3. The image forming apparatus 1 also includes an integrated circuit C1 (see FIG. 10).

The image forming portion 2 includes a photosensitive drum 4, a charging portion 5, a developing portion 6, a toner container 7, a transfer roller 8, an electricity removing portion 9, a laser scanning unit 10, a fixing roller 11, and a pressure roller 12. The image forming portion 2 forms an image on a sheet supplied from a sheet feed cassette (sheet feeder) 13 of the sheet feed portion 3, by electrophotography.

Figure 2:
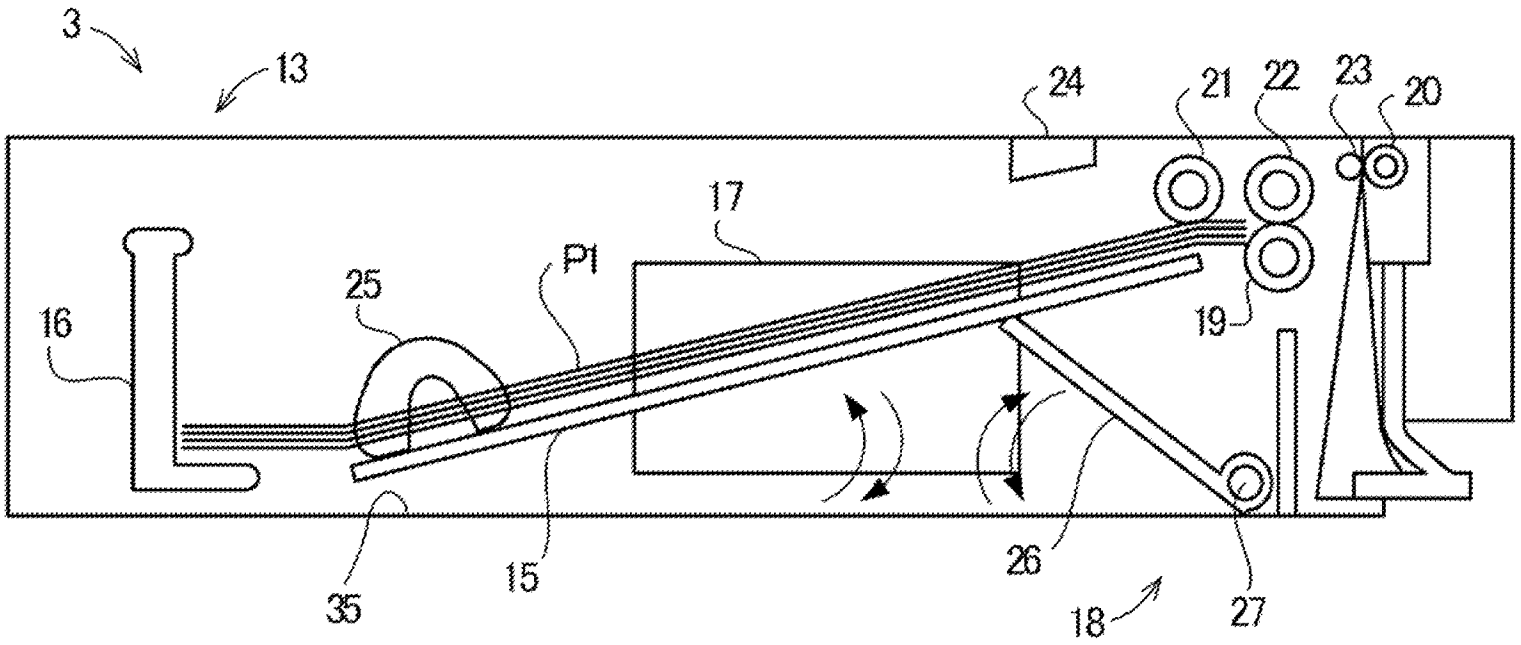
FIG. 2 is a diagram showing the configuration of a sheet feed portion of the image forming apparatus shown in FIG. 1.

As shown in FIG. 2, the sheet feed portion 3 includes the sheet feed cassette 13, a separation roller 19, a conveying roller 20, a pick-up roller 21, a conveying roller 22, a conveying roller 23, and a limiting member 24.

Figure 3:
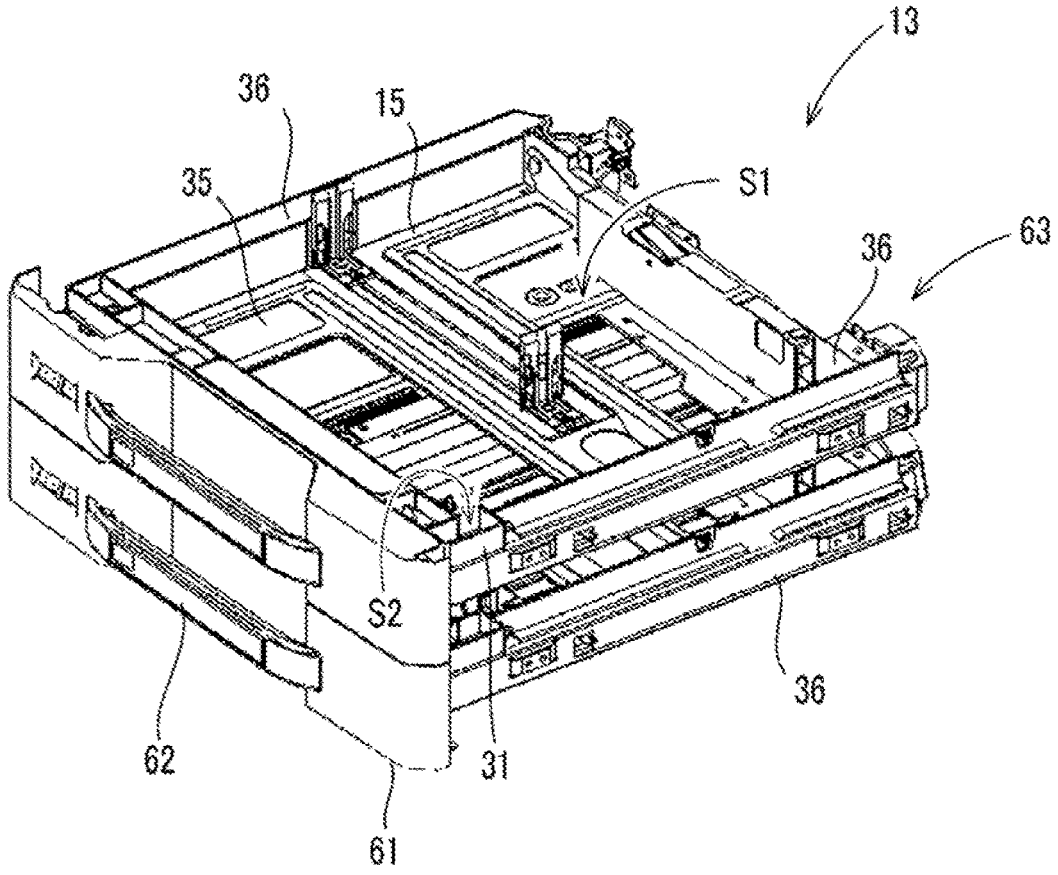
FIG. 3 is a perspective view of a sheet feeder of the image forming apparatus shown in FIG. 1.

The sheet feed cassette 13 is mountable to and detachable from a housing of the image forming apparatus 1. As shown in FIG. 3, the sheet feed cassette 13 includes: exterior portions 61 which form a part of the exterior of the image forming apparatus 1; handles 62 provided at the outer surface side of the exterior portions 61; sheet storage portions 63 which are provided at the inner side (housing interior side) of the exterior portions 61; and a fixing tool 100. Each sheet storage portion 63 forms a space S1, in which sheets are to be stored, by a bottom portion 35 and side walls 36, etc. In addition, as shown in FIG. 2, the sheet feed cassette 13 also includes cursors 16 and 17 and a lift mechanism 18. The cursor 16 determines rear end positions, in a sheet-feeding direction, of sheets placed in the sheet feed cassette 13. The cursor 17 determines sheet positions, in a direction orthogonal to the sheet-feeding direction, of the sheets placed in the sheet feed cassette 13.

The lift mechanism 18 includes a lift plate 15, a support portion 25, a lifting member 26, and a drive shaft 27. The lift plate 15 is provided on the bottom portion 35 of the sheet feed cassette 13, and sheets of various sizes are to be placed on the lift plate 15. The lift mechanism 18 lifts and lowers the lift plate 15 relative to the pick-up roller 21 in order to position the sheets placed on the lift plate 15 of the sheet feed cassette 13, to a feeding position at which the sheets can be fed. The lift plate 15 is an example of a sheet support plate in the present disclosure.

A pair of through holes 28A and 28B described later (see FIG. 9) are formed in the lift plate 15. The support portion 25 rotatably supports the lift plate 15 at a rear end, in the sheet-feeding direction, of the lift plate 15. The lifting member 26 lifts and lowers the front end of the lift plate 15 relative to the pick-up roller 21. The drive shaft 27 rotatably supports the lifting member 26. In the present embodiment, the lift mechanism 18 lifts and lowers the front end portion, in the sheet-feeding direction, of the lift plate 15 relative to the pick-up roller 21, thereby lifting and lowering a front end portion, in the sheet-feeding direction, of the uppermost sheet P1 relative to the pick-up roller 21, but an embodiment in which the entire sheets are moved parallel up and down (lifted and lowered) is also conceivable as another embodiment.

The pick-up roller 21 comes into contact with the uppermost sheet P1 in the sheet feed cassette 13, and feeds, one by one, sheets P1 in order from this sheet P1 to the image forming portion 2. The sheets P1 sent by the pick-up roller 21 are conveyed, one by one, to the conveying roller 23 and the conveying roller 20 by the conveying roller 22 and the separation roller 19.

The integrated circuit C1 is a microcomputer including a CPU, a ROM, and a RAM, etc., and is an electronic circuit which centrally controls the image forming apparatus 1. The integrated circuit C1 is mountable to and detachable from an IC socket SK1 which is mounted on a control board SB1 (see FIG. 10). In the ROM, processing programs for causing the CPU to execute various processes are stored, and various adjustment data adjusted during manufacture of the image forming apparatus 1, the number of sheets to be printed in the image forming apparatus 1, a driving time of the photosensitive drum 4, and identification information of the image forming apparatus 1, etc. are also stored.

Meanwhile, the integrated circuit C1 mounted in the image forming apparatus 1 is rarely pulled out from the IC socket SK1. Thus, a user or a service man may not carry a pulling-out tool for pulling out the integrated circuit C1. On the other hand, in the image forming apparatus 1 according to the present embodiment, the fixing tool 100 can be used both for fixing the lift plate 15 and for pulling out the integrated circuit C1.

Figure 4:
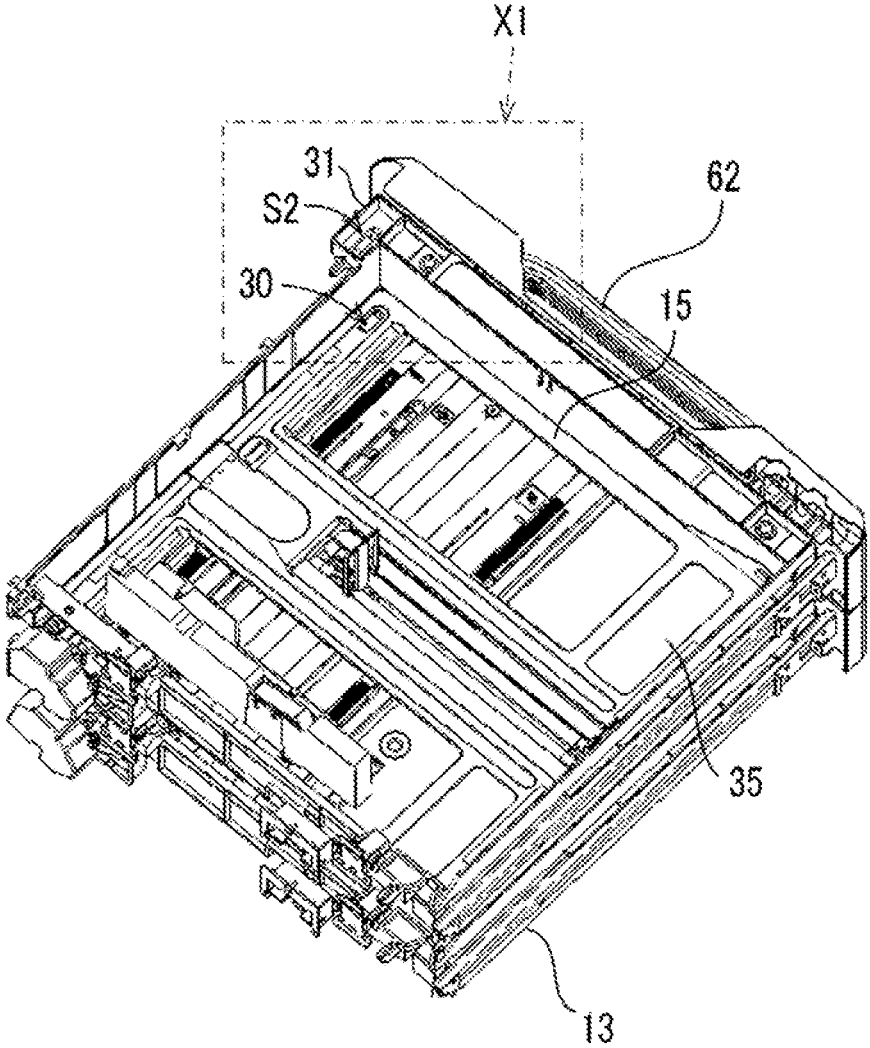
FIG. 4 is a perspective view of the sheet feeder as seen from a direction different from that of FIG. 3.
Figure 5:
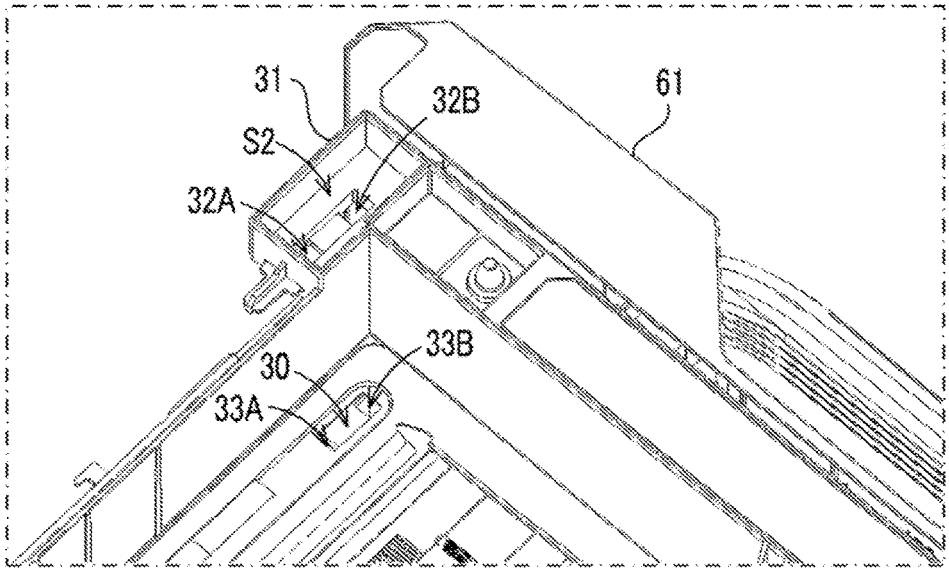
FIG. 5 is an enlarged view of a portion X1 in FIG. 4.

As shown in FIGS. 3, 4, and 5, the sheet feed cassette 13 includes a lift plate holding portion 30 and a fixing tool storage portion 31.

The lift plate holding portion 30 is a portion to which the fixing tool 100 is attached in fixing (holding) the lift plate 15 to the bottom portion 35 of the sheet feed cassette 13. Specifically, the lift plate holding portion 30 has a pair of through holes 33A and 33B (see FIG. 5) which arms 104A and 104B of the fixing tool 100 can penetrate. The pair of through holes 33A and 33B are provided in the bottom portion 35 of the sheet feed cassette 13. In the present embodiment, the pair of through holes 33A and 33B are provided near the fixing tool storage portion 31.

The pair of through holes 28A and 28B (see FIG. 9) formed in the lift plate 15 are formed at positions corresponding to the pair of through holes 33A and 33Bs which are provided in the bottom portion 35 of the sheet feed cassette 13. That is, the pair of through holes 28A and 28B are formed at such positions that, when the lift plate 15 overlaps the bottom portion 35 of the sheet feed cassette 13, the pair of through holes 28A and 28B positionally coincide with the pair of through holes 33A and 33B.

Figure 6:
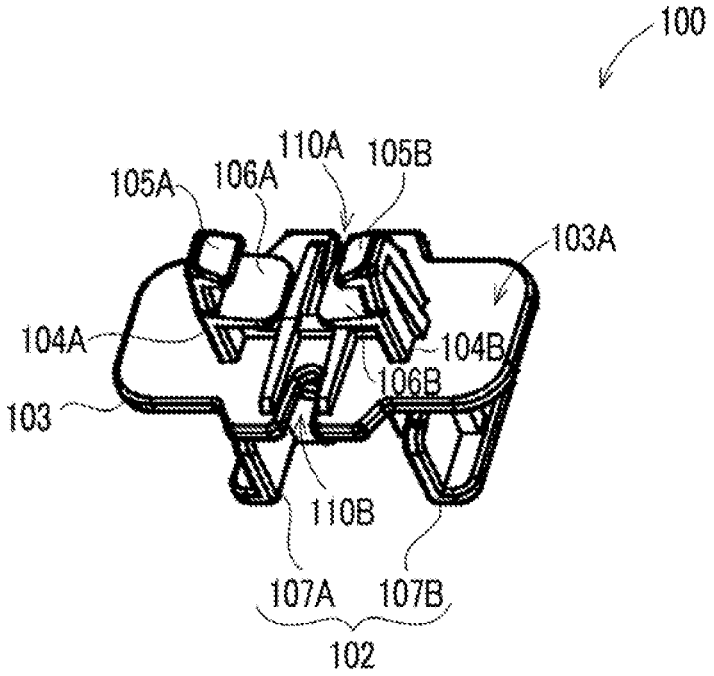
FIG. 6 is a perspective view of a fixing tool according to the first embodiment as seen from the arm side.
Figure 7:
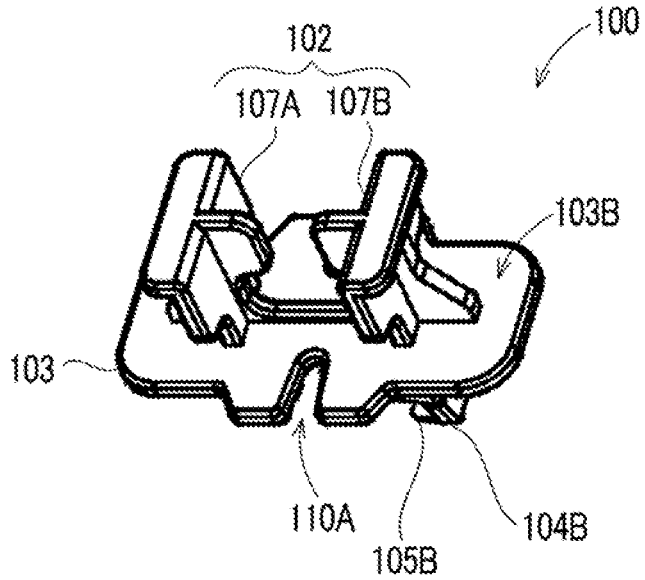
FIG. 7 is a perspective view of the fixing tool according to the first embodiment as seen from the operation portion side.
Figure 8:
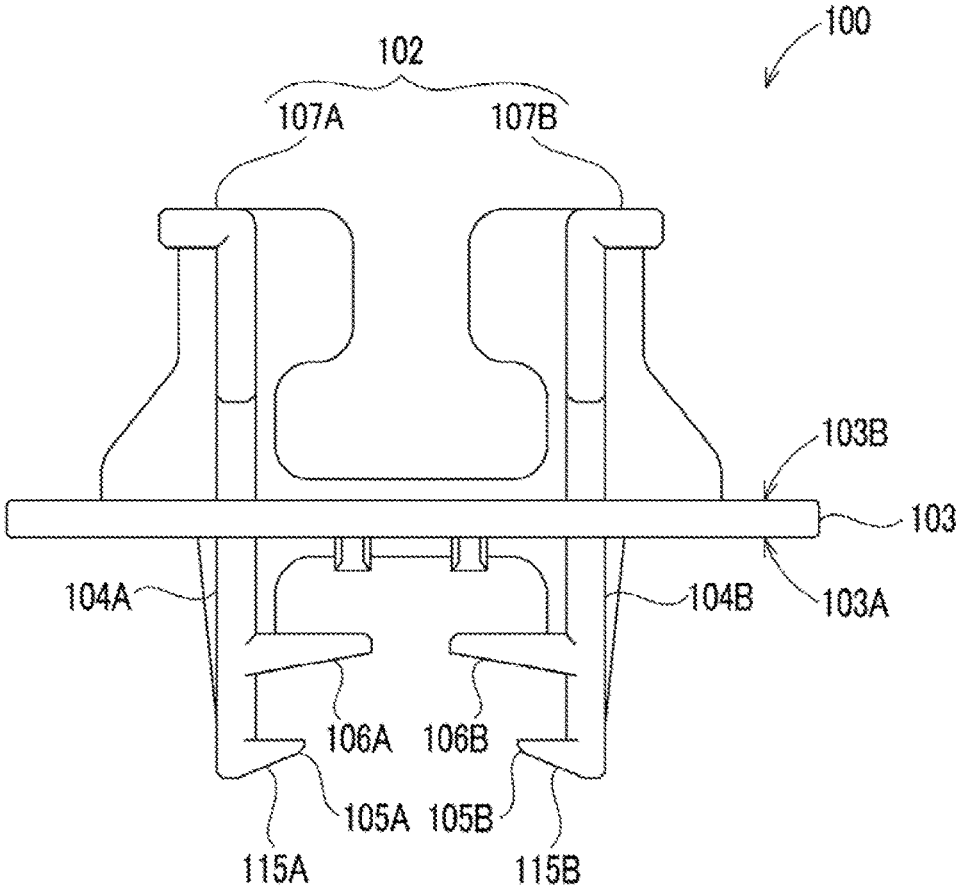
FIG. 8 is a side view of the fixing tool according to the first embodiment.

As shown in FIGS. 6, 7, and 8, the fixing tool 100 includes an operation portion 102, a plate portion 103, and the pair of arms 104A and 104B. The fixing tool 100 is formed from a synthetic resin in the present embodiment, but an embodiment in which the fixing tool 100 is formed from a metal is also conceivable as another embodiment.

The plate portion 103 is a plate-like portion, and has a pair of cutouts 110A and 110B as shown in FIGS. 6 and 7. The cutouts 110A and 110B will be described later.

The pair of arms 104A and 104B are provided on a first surface 103A which is one of surfaces of the plate portion 103 at both sides. Specifically, the pair of arms 104A and 104B extend perpendicularly from the first surface 103A so as to be spaced apart from each other by a predetermined distance. That is, the pair of arms 104A and 104B are connected to each other by the plate portion 103. In other words, the plate portion 103 has a function as a connecting portion which connects the pair of arms 104A and 104B to each other. The pair of arms 104A and 104B can be inserted into and pulled out from through holes 33A and 33B and the through holes 28A and 28B.

The pair of arms 104A and 104B include claw portions 105A and 105B and projection portions 106A and 106B. The claw portions 105A and 105B project inward from the distal ends of the respective arms 104A and 104B. The claw portions 105A and 105B are formed in tapered shapes by tapered surfaces 115A and 115B, and at least distal end portions thereof are each formed with such a thickness as to be able to be inserted into a gap SP1 between the integrated circuit C1 and the IC socket SK1 mounted in the image forming apparatus 1. In the present embodiment, the tapered surfaces 115A and 115B are formed at the distal end side among the distal end side and the plate portion 103 side of the arms 104A and 104B, but may be formed at the plate portion 103 side, or may be formed at both sides. The IC socket SK1 is an example of a mounting target portion in the present disclosure.

The projection portions 106A and 106B are provided on the inner surfaces of the arms 104A and 104B and at positions away from the claw portions 105A and 105B by a predetermined distance in the longitudinal direction of the arms 104A and 104B, and project inward from the arms 104A and 104B. The separation distance between the projection portions 106A and 106B and the claw portions 105A and 105B is slightly longer than the sum of the thickness of the lift plate 15 and the thickness of the bottom portion 35 of the sheet feed cassette 13.

The operation portion 102 is provided on a second surface 103B which is the other of the surfaces of the plate portion 103 at both sides. The operation portion 102 includes a pair of operation pieces 107A and 107B. The pair of operation pieces 107A and 107B extend perpendicularly from the second surface 103B so as to be spaced apart from each other by a predetermined distance. That is, the pair of operation pieces 107A and 107B are connected to each other by the plate portion 103. In addition, the operation piece 107A is provided at the side opposite to the arm 104A with respect to the plate portion 103, and the other operation piece 107B is provided at the side opposite to the other arm 104B with respect to the plate portion 103.

Here, the pair of cutouts 110A and 110B formed in the plate portion 103 will be described. The pair of cutouts 110A and 110B are provided at positions between the arm 104A and the other arm 104B. The pair of cutouts 110A and 110B each have a shape which is long in a direction along a straight line orthogonal to the direction in which the pair of arms 104A and 104B are aligned. The plate portion 103 is elastically deformable since the plate portion 103 has such a pair of cutouts 110A and 110B. Specifically, the plate portion 103 is elastically bendable such that the pair of arms 104A and 104B become more separated from each other than in a natural state where no external force is applied thereto (see FIG. 10). The plate portion 103 is an example of an elastic portion in the present disclosure.

Figure 9:
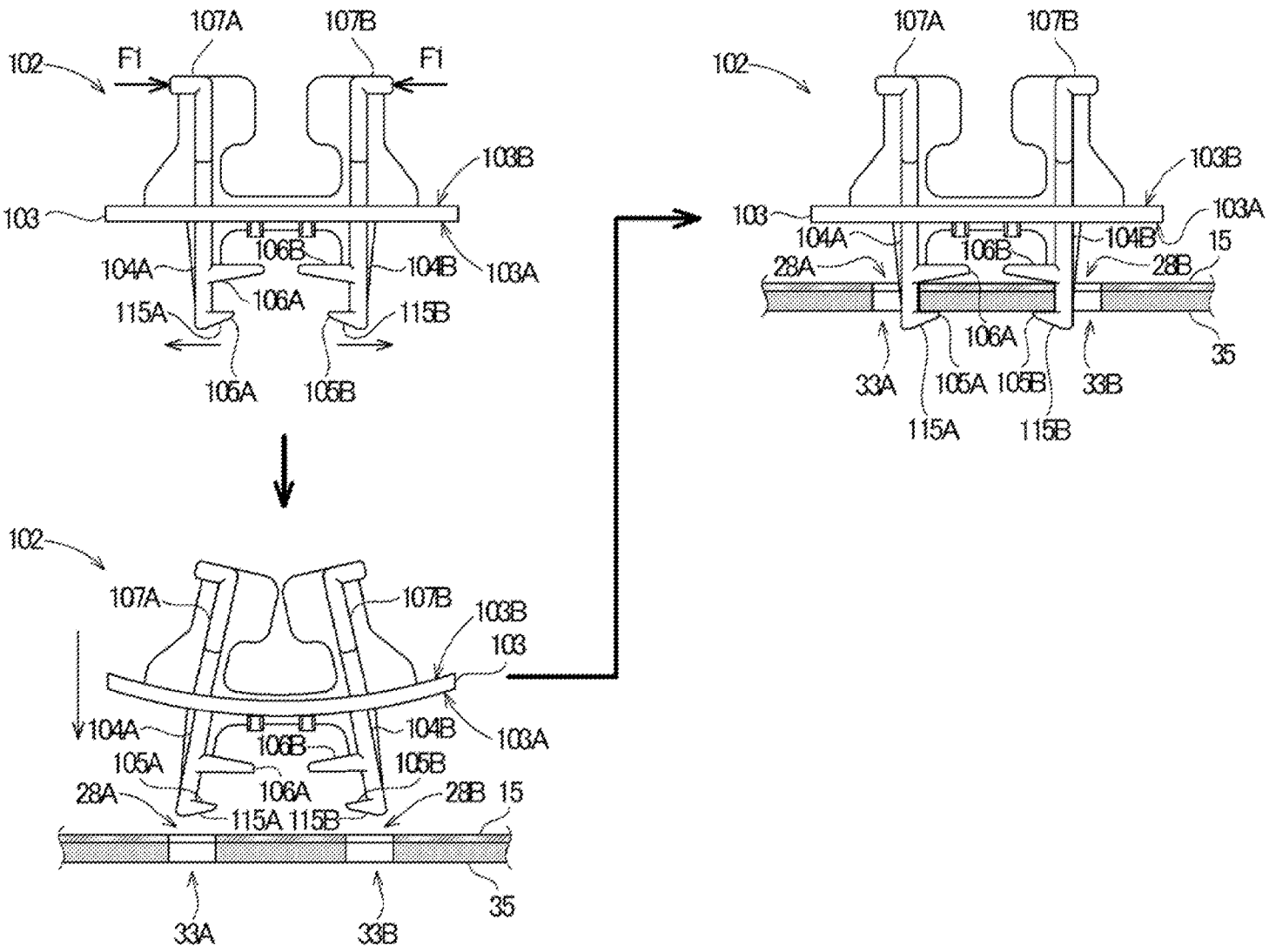
FIG. 9 is a diagram illustrating an operation method for obtaining a state where a lift plate is fixed to a bottom portion of the sheet feeder by means of the fixing tool according to the first embodiment.

Regarding the fixing tool 100 having such a configuration, as shown in FIG. 9, when a pinching operation of applying an operation force F1 to the pair of operation pieces 107A and 107B such that the pair of operation pieces 107A and 107B come close to each other is performed, the plate portion 103 elastically bends as described above, so that the distal ends of the pair of arms 104A and 104B become more separated from each other. That is, a state where the pair of arms 104A and 104B are more open is obtained. Then, when the separation distance between the distal ends of the pair of arms 104A and 104B becomes equal to a distance corresponding to the separation distance between the through holes 28A and 33A and the other through holes 28B and 33B which are respectively formed in the lift plate 15 and the bottom portion 35 of the sheet feed cassette 13, the pair of arms 104A and 104B become enabled to penetrate the through holes 28A, 28B, 33A, and 33B.

When the pair arms 104A and 104B are caused to penetrate the through holes 28A, 28B, 33A, and 33B and the application of the operation force F1 to the operation portion 102 is stopped in a state where the projection portions 106A and 106B are in contact with the lift plate 15, a state where the lift plate 15 and the bottom portion 35 of the sheet feed cassette 13 are held between the claw portions 105A and 105B and the projection portions 106A and 106B, is obtained. Thus, the lift plate 15 is fixed (held) with respect to the bottom portion 35 of the sheet feed cassette 13 in the normal direction. As a result, even when vibration is transmitted to the lift plate 15 during transport of the image forming apparatus 1, the lift plate 15 can be prevented from jumping up from the bottom portion 35 of the sheet feed cassette 13. The claw portions 105A and 105B and the projection portions 106A and 106B are an example of a holding portion in the present disclosure. Each of the claw portions 105A and 105B forms a part of the holding portion, but may be provided independently of the holding portion.

In a state where the lift plate 15 is fixed (held) as described above, the state (shape) of the fixing tool 100 may be the same as the natural state, but may be a state where the plate portion 103 is bent to be elastically deformed such that the distal ends of the arms 104A and 104B become more separated from each other than in the natural state (the arms 104A and 104B are open). That is, the pair of arms 104A and 104B may be connected to each other via the plate portion 103 which has such elasticity that the pair of arms 104A and 104B return in a direction in which the pair of arms 104A and 104B come close to each other, from a state where the pair of arms 104A and 104B can be inserted into the through holes 28A, 28B, 33A, and 33B. In this case, by the restoring force by which the distal end sides of the arms 104A and 104B attempt to come close to each other, the portions between the through holes 28A and 33A and the other through holes 28B and 33B in the lift plate 15 and the bottom portion 35 of the sheet feed cassette 13 are sandwiched between the arms 104A and 104B. Thus, in this case, the lift plate 15 is fixed (held) with respect to the bottom portion 35 of the sheet feed cassette 13 also in the direction parallel to the surface of the lift plate 15.

A space S2 in which the fixing tool 100 can be stored is formed in the fixing tool storage portion 31. Specifically, the fixing tool storage portion 31 is provided at an inner wall of each exterior portion 61 which is provided at a front-side end portion of the sheet feed cassette 13. Thus, in taking out the fixing tool 100 from the fixing tool storage portion 31, or in storing the fixing tool 100 into the fixing tool storage portion 31 after the fixing tool 100 is used, the sheet feed cassette 13 may be pulled out by a user by only a small amount.

In addition, a pair of through holes 32A and 32B (see FIG. 5) are formed in a bottom portion of the fixing tool storage portion 31. The arms 104A and 104B of the fixing tool 100 can penetrate the pair of through holes 32A and 32B. Thus, the fixing tool 100 is stored in the fixing tool storage portion 31 in a state where the arms 104A and 104B has penetrated the pair of through holes 32A and 32B. Because of such a stored manner, movement of the fixing tool 100 is restricted by the through holes 32A and 32B, so that the fixing tool 100 is prevented from rolling in the fixing tool storage portion 31 due to insertion/pulling of the sheet feed cassette 13.

In the image forming apparatus 1 according to the present embodiment, the fixing tool 100, which is used for fixing the lift plate 15, can also be used as a puffing-out tool for pulling out the integrated circuit C1 from the IC socket SK1 which is provided on the control board SB1 of the image forming apparatus 1.

Figure 10:
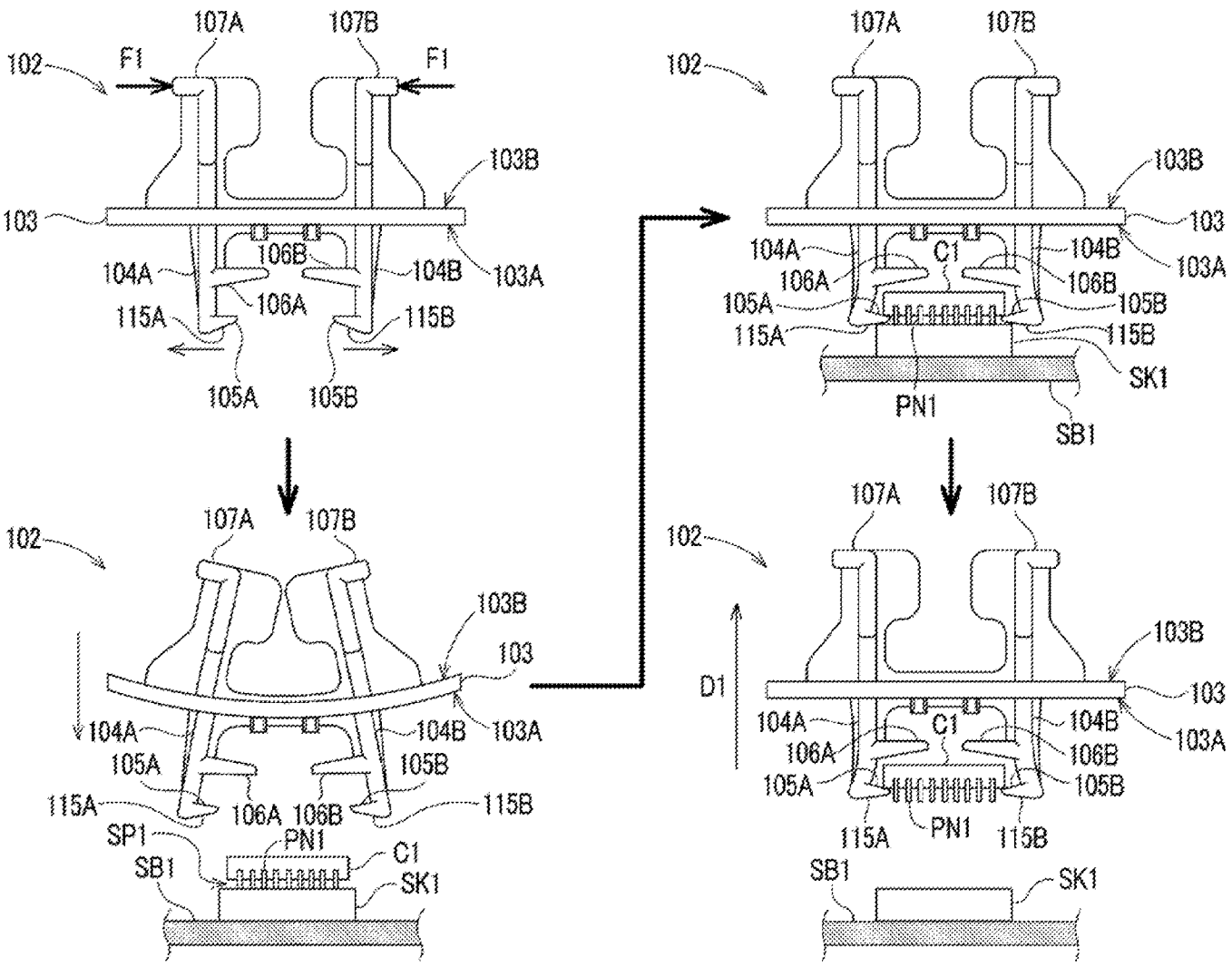
FIG. 10 is a diagram illustrating an operation method for pulling out an integrated circuit from an IC socket by means of the fixing tool according to the first embodiment.

That is, as shown in FIG. 10, similarly to when fixing the lift plate 15, the plate portion 103 is bent by the operation force F1 being applied to the operation portion 102, so that the respective distal ends of the pair of arms 104A and 104B become more separated from each other. Then, in a state where the claw portions 105A and 105B are located at the gap SP1 between the integrated circuit C1 and the IC socket SK1 for the integrated circuit C1, when the application of the operation force F1 is stopped, the claw portions 105A and 105B enter the gap SP1.

Here, since the claw portions 105A and 105B each have a tapered shape, when the claw portions 105A and 105B enter the gap SP1 because of the restoring force generated during restoration of the plate portion 103, the claw portions 105A and 105B separate the integrated circuit C1 from the IC socket SK1 by a predetermined distance. Therefore, even when connection pins PN1 of the integrated circuit C1 are relatively firmly inserted into the IC socket SK1, the state where the connection pins PN1 are relatively firmly inserted into the IC socket SK1 is alleviated. Then, by the fixing tool 100 being pulled up in a direction D1 away from the IC socket SK1, the integrated circuit C1 is pulled out from the IC socket SK1.

As described above, the fixing tool 100, which can fix the lift plate 15 to the bottom portion 35 of the sheet feed cassette 13, can also be used as a pulling-out tool for pulling out the integrated circuit C1 from the IC socket SK1. In addition, in the image forming apparatus 1, since the fixing tool storage portion 31 in which the fixing tool 100 can be stored is provided in the sheet feed cassette 13, the image forming apparatus 1 can always be provided with the fixing tool 100. Accordingly, when an operation of pulling out the integrated circuit C1 becomes necessary, this operation can be immediately carried out.

Second Embodiment

In a second embodiment, a fixing tool 200 having a configuration different from that of the fixing tool 100 according to the first embodiment will be described with reference to FIGS. 11 to 13. In the present embodiment, only the difference from the first embodiment will be described, and the description of the points in common with the first embodiment is omitted.

Figure 11:
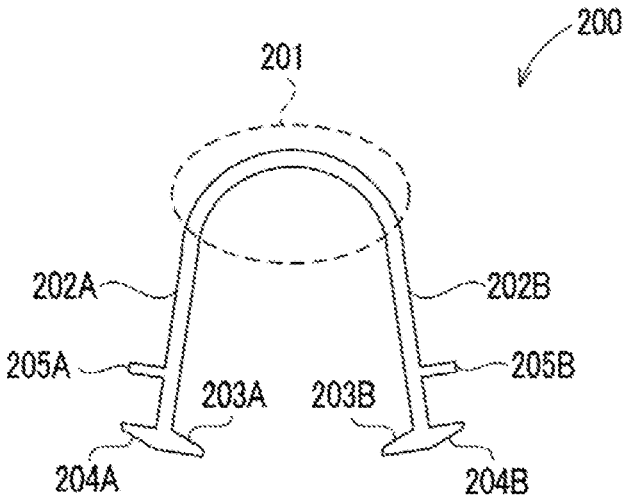
FIG. 11 is a side view of a fixing tool according to a second embodiment.

As shown in FIG. 11, the fixing tool 200 according to the second embodiment includes a curved portion 201 and a pair of arms 202A and 202B. In addition, as shown in FIG. 12, in the present embodiment, one through hole 41 and one through hole 42 are provided in the bottom portion 35 of the sheet feed cassette 13 and the lift plate 15, respectively.

The curved portion 201 is a portion which is curved in a U shape and has elasticity. The curved portion 201 is an example of the elastic portion in the present disclosure. The pair of arms 202A and 202B extend from end portions of the curved portion 201 such that, in the above natural state, the separation distance therebetween increases as distance to the distal ends thereof decrease. In other words, the curved portion 201 has a function as a connecting portion which connects the pair of arms 202A and 202B to each other in an open state.

The pair of arms 202A and 202B are provided with claw portions 203A and 203B, first projection portions 204A and 204B, and second projection portions 205A and 205B. The claw portions 203A and 203B project inward from the distal ends of the respective arms 202A and 202B. Each of the claw portions 203A and 203B has a tapered shape, and at least a distal end portion thereof is formed with such a thickness as to be able to be inserted into the gap SP1 between the integrated circuit C1 and the IC socket SK1.

The first projection portions 204A and 204B project outward from the distal ends of the respective arms 202A and 202B. The second projection portions 205A and 205B are provided on the outer surfaces of the arms 202A and 202B and at positions away from the first projection portions 204A and 204B by a predetermined distance in the longitudinal direction of the arms 202A and 202B, and project from the outer surfaces of the arms 202A and 202B. The separation distance between the first projection portions 204A and 204B and the second projection portions 205A and 205B is slightly longer than the sum of the thickness of the lift plate 15 and the thickness of the bottom portion 35 of the sheet feed cassette 13.

Figure 12:
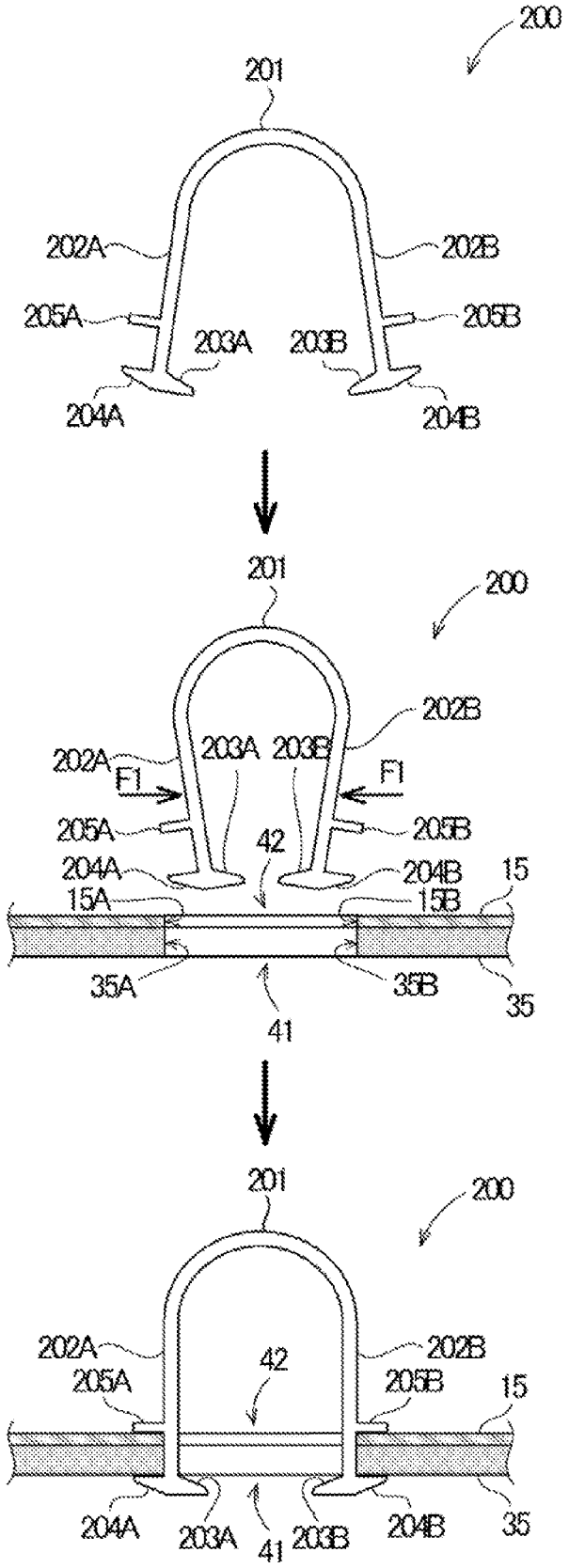
FIG. 12 is a diagram illustrating an operation method for obtaining a state where a lift plate is fixed to a bottom portion of a sheet feeder by means of the fixing tool according to the second embodiment.

Regarding the fixing tool 200 having such a configuration, as shown in FIG. 12, when a pinching operation is performed on the pair of arms 202A and 202B, the curved portion 201 elastically deforms, and the distal ends of the pair of arms 202A and 202B come close to each other. That is, a state where the pair of arms 202A and 202B are more closed is obtained. When the separation distance between the distal ends of the pair of arms 202A and 202B becomes equal to a distance corresponding to the widths of the through holes 41 and 42 which are respectively formed in the bottom portion 35 of the sheet feed cassette 13 and the lift plate 15, the pair of arms 202A and 202B become enabled to penetrate the through holes 41 and 42.

Then, when the pair of arms 202A and 202B are caused to penetrate the through holes 41 and 42 and the application of the operation force F1 to the arms 202A and 202B is stopped in a state where the second projection portions 205A and 205B are in contact with the lift plate 15, a state where the lift plate 15 and the bottom portion 35 of the sheet feed cassette 13 are held between the first projection portions 204A and 204B and the second projection portions 205A and 205B, is obtained. Thus, the lift plate 15 is fixed (held) with respect to the bottom portion 35 of the sheet feed cassette 13 in the normal direction. As a result, even when vibration is transmitted to the lift plate 15 during transport of the image forming apparatus 1, the lift plate 15 can be prevented from jumping up from the bottom portion 35 of the sheet feed cassette 13. The first projection portions 204A and 204B and the second projection portions 205A and 205B are an example of the holding portion in the present disclosure.

In a state where the lift plate 15 is fixed (held), the state (shape) of the fixing tool 200 may be the same as the natural state, but may be a state where the curved portion 201 is bent to be elastically deformed such that the distal ends of the arms 202A and 202B are closer to each other than in the natural state. That is, the pair of arms 202A and 202B are connected to each other via an elastic portion (the curved portion 201) which has such elasticity that the pair of arms 202A and 202B return in a direction in which the pair of arms 202A and 202B move away from each other, from a state where the pair of arms 202A and 202B can be inserted into the through holes 41 and 42, so that, by the restoring force by which the distal end sides of the arms 202A and 202B attempt to move away from each other, edge portions 15A and 35A of the through holes 42 and 41 which are in contact with the arm 202A and other edge portions 15B and 35B of the through holes 42 and 41 which are in contact with the arm 202B are pressed outward by the arms 202A and 202B, respectively. Thus, in this case, the lift plate 15 is fixed (held) with respect to the bottom portion 35 of the sheet feed cassette 13 also in the direction parallel to the surface of the lift plate 15.

Similarly to the fixing tool 100 according to the first embodiment, the fixing tool 200 also has a function as a puffing-out tool for pulling out the integrated circuit C1 from the IC socket SK1.

Figure 13:
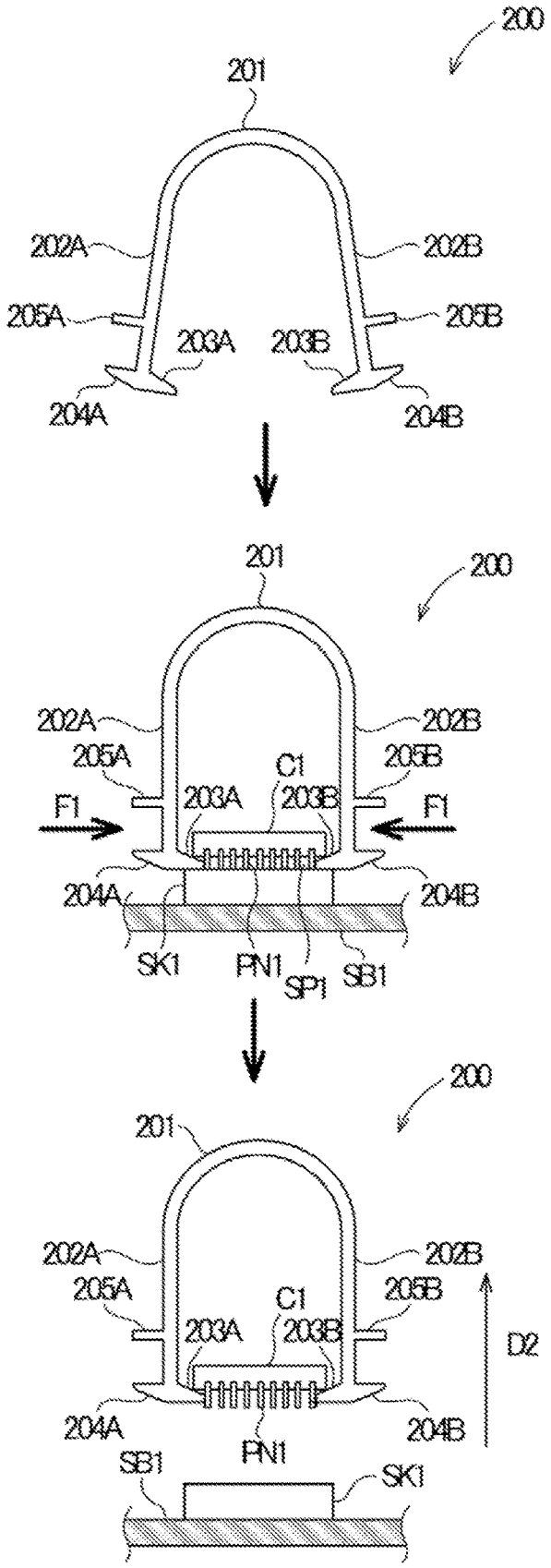
FIG. 13 is a diagram illustrating an operation method for pulling out an integrated circuit from an IC socket by means of the fixing tool according to the second embodiment.

That is, as shown in FIG. 13, in a state where the claw portions 203A and 203B are located at the gap SP1 between the integrated circuit C1 and the IC socket SK1, similarly to when fixing the lift plate 15, the curved portion 201 is bent by the operation force F1 being applied, so that the respective distal ends of the pair of arms 202A and 202B come close to each other and the claw portions 203A and 203B enter the gap SP1.

Here, since the claw portions 203A and 203B each have a tapered shape, when the claw portions 203A and 203B enter the gap SP1 because of the operation force F1, the claw portions 203A and 203B separate the integrated circuit C1 from the IC socket SK1 by a predetermined distance. Therefore, even when the connection pins PN1 of the integrated circuit C1 are relatively firmly inserted into the IC socket SK1, the state where the connection pins PN1 are relatively firmly inserted into the IC socket SK1 is alleviated. Then, by the fixing tool 200 being pulled up in a direction D2 away from the IC socket SK1, the integrated circuit C1 is pulled out from the IC socket SK1.

As described above, the fixing tool 200, which can fix the lift plate 15 to the bottom portion 35 of the sheet feed cassette 13, can also be used as a pulling-out tool for pulling out the integrated circuit C1 from the IC socket SK1. In addition, in the image forming apparatus 1, since the fixing tool storage portion 31 in which the fixing tool 200 can be stored is provided in the sheet feed cassette 13, the image forming apparatus 1 can always be provided with the fixing tool 200. Accordingly, when an operation of pulling out the integrated circuit C1 becomes necessary, this operation is immediately enabled.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus including a fixing tool comprising:

a pair of arms capable of being inserted into and pulled out from through holes formed respectively in a sheet support plate of the image forming apparatus, which supports a sheet stored in a sheet feeder of the image forming apparatus such that the sheet is configured to be lifted and lowered, and in a bottom portion of the sheet feeder;

a holding portion provided so as to project from a predetermined position on each of the arms and fix the sheet support plate to the bottom portion of the sheet feeder by holding the sheet support plate and the bottom portion; and a claw portion provided so as to project inward from a distal end of each of the arms and capable of being inserted between an integrated circuit mounted in the image forming apparatus and a mounting target portion which the integrated circuit is mountable to and detachable from.

2. The image forming apparatus according to claim 1, wherein the pair of arms are connected to each other via an elastic portion having such elasticity that the pair of arms return in a direction in which the pair of arms come close to each other, from a state where the pair of arms can be inserted into the through holes, and the holding portion is provided so as to project inward from each of the arms.

3. The image forming apparatus according to claim 2, wherein the through holes include two through holes provided in each of the sheet support plate and the bottom portion of the sheet feeder, and the respective arms penetrate the through holes of the sheet support plate and the through holes of the bottom portion.

4. The image forming apparatus according to claim 1, wherein the pair of arms are connected to each other via an elastic portion having such elasticity that the pair of arms return in a direction in which the pair of arms move away from each other, from a state where the pair of arms can be inserted into the through holes, and the holding portion is provided so as to project outward from each of the arms.

5. The image forming apparatus according to claim 1, further comprising:

an image forming portion configured to form an image on a sheet supplied from the sheet feeder, wherein the sheet feeder includes the fixing tool and a storage portion in which the fixing tool is configured to be stored.

* * * * *